United States Patent [19]

Visser

[11] Patent Number: 4,651,616

[45] Date of Patent: Mar. 24, 1987

[54] MOUTHPIECE FOR WIND INSTRUMENT WITH SINGLE REED

[76] Inventor: Norbert Visser, Valkenlaan 72, 1871 AV Schoorl, Netherlands

[21] Appl. No.: 851,033

[22] Filed: Apr. 11, 1986

[30] Foreign Application Priority Data

Apr. 18, 1985 [NL] Netherlands ..... 8501136

[51] Int. Cl.[4] ..... G10D 9/02

[52] U.S. Cl. ..... 84/383 R

[58] Field of Search ..... 84/380, 383 R, 383 A

[56] References Cited

U.S. PATENT DOCUMENTS

| | | | |
|---|---|---|---|
| 2,397,593 | 4/1946 | Brilhart | 84/383 R |
| 2,525,523 | 10/1950 | Chance | 84/383 R |
| 3,202,032 | 8/1965 | Strathmann | 84/383 R |

FOREIGN PATENT DOCUMENTS

| | | | |
|---|---|---|---|
| 603056 | 4/1926 | France | 84/383 R |
| 656634 | 4/1929 | France | 84/383 R |

*Primary Examiner*—Lawrence R. Franklin
*Attorney, Agent, or Firm*—John P. Snyder

[57] ABSTRACT

This invention relates to a mouthpiece for a clarinet or other wind instrument using a single reed with a tone chamber covered by the reed.

In the perception which lies at the foundation of the present invention, no substantial improvement in tone can be achieved by making changes to each individual component part, but the sound of any musical instrument, such as the wind instrument concerned here, is only really improved by working on the basis of an integrated approach. This should be understood as implying that, according to the invention, an essential relationship exists between the vibratory element and the resonance element. It is then also of critical importance that both elements concur in a harmonious way. In the absence of this, an instrument can not have the tone quality which is in principle possible.

According to the invention, a mouthpiece for a clarinet, saxophone or suchlike instrument with a single reed now displays the feature that the tone chamber has, grosso modo, the form of a constricted teardrop, that the reed at the point of construction of that chamber displays at least one hole, and that in the transitional zone between the tone chamber and the resonance tube there is located a, placed on a stalk and embodied as a polyhedron, acoustic member.

11 Claims, 6 Drawing Figures

MOUTHPIECE FOR WIND INSTRUMENT WITH SINGLE REED

This invention relates to a mouthpiece for a clarinet or other wind instrument using a single reed with a tone chamber covered by the reed. Such a mouthpiece is generally known. Reference may be made for example to German Auslege 1.217.758, U.S. Pat. Not. 4,347,776, German Offenlegungsschrift 25.21.472, and U.S. Pat. No. 4,145,949.

Although it is apparent from the above literature references that the configuration, dimensioning, choice of materials, etc. of all elements which form part of the mouthpiece have been the subject of much study and work, the modern tone development of a clarinet or saxophone requires largely new constructions. Even a mouthpiece such as is known from U.S. Pat. No. 4,449,439, which shows unmistakable signs of a most meticulous construction, is in this sense not yet satisfactory.

In the perception which lies at the foundation of the present invention, no substantial improvement in tone can be achieved by making changes to each individual component part, but the sound of any musical instrument, such as the wind instrument concerned here, is only really improved by working on the basis of an integrated approach. This should be understood as implying that, according to the invention, an essential relationship exists between the vibratory element and the resonance element. It is then also of critical importance that both elements concur in a harmonious way. In the absence of this, an instrument can not have the tone quality which is in principle possible.

According to the invention, a mouthpiece for a clarinet, saxophone or suchlike instrument with a single reed now displays the feature that the tone chamber has, substantially, the form of a constricted teardrop, that the reed at the point of construction of that chamber displays at least one hole, and that in the transitional zone between the tone chamber and the resonance tube there is located an acoustic member placed on a stalk and embodied as a polyhedron. From this it is apparent that a combination of three aspects is required for the superior tone achieved by the construction according to the invention. First of all, the tone chamber with the general form of a constricted teardrop is of importance; secondly, the presence of at least one hole in the reed at the place of the constriction of the tone chamber is important, which hole can advantageously display the form of a teardrop whose point is directed towards the resonance tube; and thirdly the presence of an acoustic member located in the airstream is important.

Through experiments it has now been established that a wind instrument with the construction as proposed by the invention does in fact bring the desired improvement in sound, giving a rounded tone with a horn-like timbre.

In a simple embodiment, the tone chamber can be at least partially formed in an insert piece.

Further characteristics and particulars will be mentioned and explained by reference to the drawing of several arbitrary embodiment examples. In the drawings.

Figure 1:
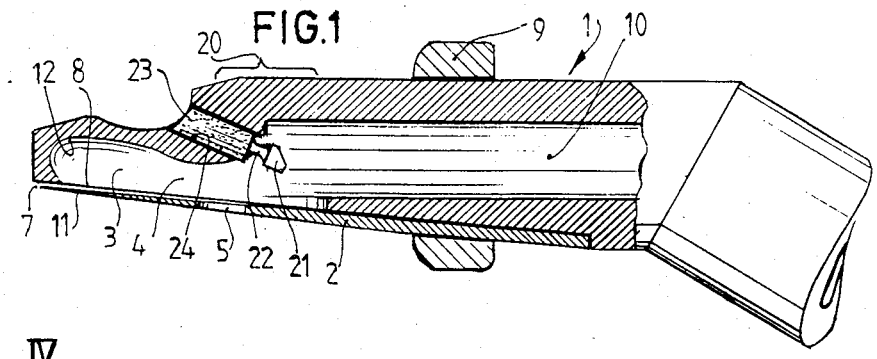
FIG. 1 shows a cross section of a first embodiment example.

FIG. 1 shows a mouthpiece 1 with a tone chamber 3 covered by a reed 2. This tone chamber 3 displays substantially the form of a constricted teardrop. The constriction is denoted by reference number 4. See for this also FIG. 2. The reed 2 displays at the point of the constriction 4 in the first embodiment example according to FIGS. 1 to 4 a teardrop-shaped hole 5.

In a transitional zone 20 between the tone chamber 3 and the resonance tube 10 is located an acoustic member 21. This acoustic member 21 is placed on a stalk 22 and is embodied as a polyhedron. For particulars relating to this acoustic member, special reference is made to FIG. 5, which shows the member on an enlarged scale. The stalk 22 is, in the embodiment example according to FIGS. 1 to 6 inclusive, carried by a cork plug 23, which can be entirely accommodated in a drilling 24 in the wall of the mouthpiece 1, which drilling 24 runs from the outer surface of the mouthpiece 1 facing away from the reed 2 in the direction of the resonance tube 10 and connects thereto at an angle such that the acoustic member 21 is located in the airstream. In the embodiment according to FIG. 6, the acoustic member 21 is carried by the insert piece 17.

Figure 2:
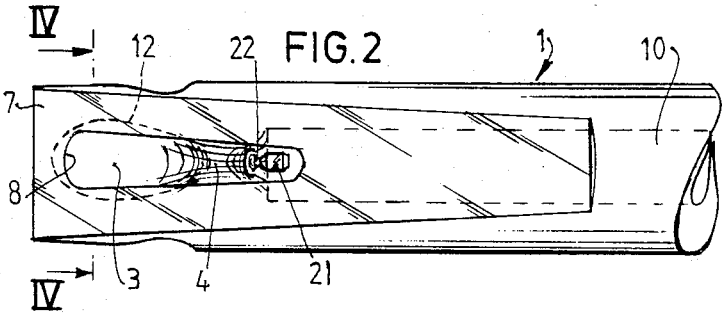
FIG. 2 shows a view from beneath of the mouthpiece according to FIG. 1, with the reed removed.

FIG. 2 shows a bottom view of the mouthpiece according to FIG. 1, with the reed removed. From this figure it is apparent that the flat bottom surface 7 which is formed on the mouthpiece 1 to accommodate the reed 2 displays an aperture 8 having a form tapering towards the right and rounded at both ends, which aperture forms the debouchement of the tone chamber 3. The reed is fastened onto the mouthpiece 1 by a clamp ring 9.

The tone chamber 3 debouches inside the mouthpiece into resonance tube 10 via a transitional zone 20.

Figure 3:
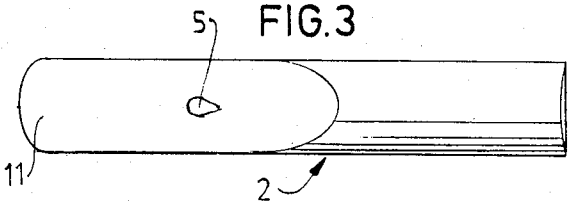
FIG. 3 shows the reed according to FIG. 1 in view from beneath.

FIG. 3 shows the reed 2 with a fairly sharply tapering free end portion 11 wherein a hole 5 is located.

Figure 4:
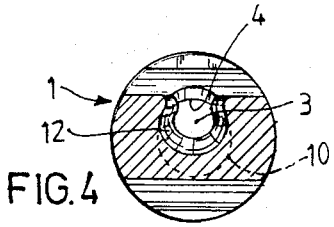
FIG. 4 shows the cross section IV—IV according to FIG. 2.
Figure 5:
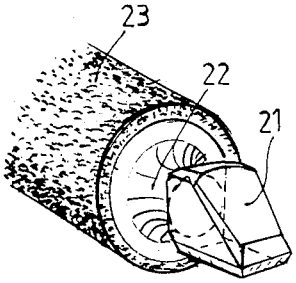
FIG. 5 shows a perspective view of an acoustic member.

FIG. 4 shows cross-section IV—IV according to FIG. 2. This figure clearly shows the form of the tone chamber 3 which displays a relatively wide portion at the front which is for clarity denoted by 12, whereof the dimensions are clearly distinct from those of the constriction 4. A broken line indicates the resonance tube 10.

Figure 6:
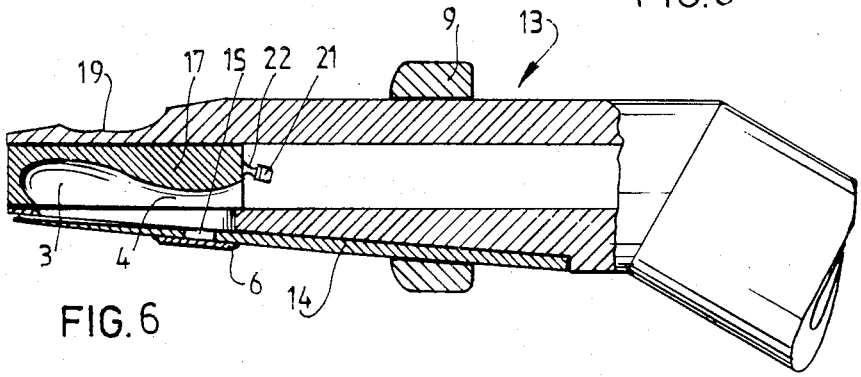
FIG. 6 shows a cross section through a second embodiment example.

FIG. 6 shows a mouthpiece 13 with a reed 14 which at the place of the constriction 4 of tone chamber 3 is provided with a hole 15 covered by a plate 6.

It is also clear form this figure that the mouthpiece 13 is embodied in tube form and that an insert piece 17 is located at the free end of the tube, which insert piece serves as the upper boundary for the tone chamber 3. Through this, the embodiment according to FIG. 6 is less expensive to manufacture than that according to FIGS. 1 to 4 inclusive.

As is apparent from FIG. 1, the exterior of the mouthpiece 1 above the tone chamber 3 is provided with a recessed portion 18 for the adaptation to and for the positive location of the musician's upper lip. In the embodiment according to FIG. 6 a recessed portion 19 with a somewhat different shape is present.

I claim:

1. A mouthpiece for a clarinet or other wind instrument with a single reed with a tone chamber covered by the reed which is connected via a transitional zone to a resonance tube, characterized in that the tone chamber has substantially the form of a constricted teardrop, that the reed at the position of the constriction of that chamber displays at least one hole, and that in the transitional zone between the tone chamber and the resonance tube there is located an acoustic member, placed on a stalk and embodied as a polyhedron.

2. A mouthpiece according to claim 1, characterized in that the hole in the reed displays a teardrop shape, whereof the point is directed towards the resonance tube.

3. A mouthpiece according to claim 2 characterized in that the exterior of the mouthpiece above the tone chamber is made recessed for the adaptation to, and the positive positioning of, the musician's upper lip.

4. A mouthpiece according to claim 2 characterized in that the tone chamber is at least partially formed in an insert piece.

5. A mouthpiece according to claim 2 characterized by a plate attached to the exterior of the reed covering said at least one hole.

6. A mouthpiece according to claim 1 characterized in that the exterior of the mouthpiece above the tone chamber is made recessed for the adaptation to, and the positive positioning of, the musician's upper lip.

7. A mouthpiece according to claim 6 characterized in that the tone chamber is at least partially formed in an insert piece.

8. A mouthpiece according to claim 6 characterized by a plate attached to the exterior of the reed covering said at least one hole.

9. A mouthpiece according to claim 1 characterized in that the tone chamber is at least partially formed in an insert piece.

10. A mouthpiece according to claim 9 characterized by a plate attached to the exterior of the reed covering said at least one hole.

11. A mouthpiece according to claim 1 characterized by a plate attached to the exterior of the reed covering said at least one hole.

* * * * *